United States Patent [19]

Dooley

[11] 4,174,023

[45] Nov. 13, 1979

[54] STAIRLIFT

[76] Inventor: Stephen J. Dooley, 112 Sewerby Rd., Bridlington, North Humberside, Y016 5UP, England

[21] Appl. No.: 849,583

[22] Filed: Nov. 8, 1977

[51] Int. Cl.[2] ..... B66B 9/08

[52] U.S. Cl. ..... 187/12; 187/24

[58] Field of Search ..... 187/12, 24, 25, 13, 187/14

[56] References Cited

U.S. PATENT DOCUMENTS

| | | | |
|---|---|---|---|
| 2,207,544 | 7/1940 | Knudsen | 187/12 |
| 2,270,735 | 1/1942 | Knudsen | 187/12 |
| 2,856,027 | 10/1958 | Schryver | 187/12 |
| 4,050,546 | 9/1977 | Wilson, Jr. | 187/24 |

*Primary Examiner*—Jeffrey V. Nase

*Attorney, Agent, or Firm*—Sughrue, Rothwell, Mion, Zinn and Macpeak

[57] ABSTRACT

A stair lift has a load bearing part with a guide rail for extending up one side of a stairway, a lead screw in the guide rail and a corresponding threaded part carried near and co-operating with the lead screw and a motor and/or turning means for rotating the lead screw wherefor no pit needs excavation an electric motor preferably locating at the head of the stairs and a chain and/or platform may span the stairs to another guide rail extending thereup.

6 Claims, 4 Drawing Figures

STAIRLIFT

This invention relates to an improved stair lift.

A stairlift is a lift platform with associated traction mechanism which is fitted to an ordinary stairway for the transport of disabled persons, or bulky goods, up and down the stairway, along an inclined path parallel to the slope of the stairs.

Our British Pat. No. 1445570 discloses a stair lift wherein a platform is carried horizontally on bogies which run in sloping guide rails, and is driven by a sprocket and chain mechanism driven by a motor located in a well at the foot of the stairs. The chain extends between terminal sprockets at each end of the respective guide rail, and the platform is driven by a sprocket mounted on the bogie. The rails at each side of the stairway are each provided with a similar sprocket and chain mechanism.

This known construction has a number of disadvantages. While it is satisfactory in use on a single straight flight of stairs, as in most modern houses, a separate lift apparatus with its own platform and motor assembly is required for each flight, as the sprocket and chain apparatus cannot function around corners. Furthermore, the necessity for excavating a pit for the motor assembly and lower ends of the guide rails, makes the installation of this form of lift costly, and also means that local conditions may in some circumstances prohibit the installations of such a lift where one is in fact essential.

An object of the invention is to provide an improved stairlift which can overcome the above mentioned disadvantages.

The invention provides a stair lift comprising, a load bearing part, a guide rail for extending up one side of a stair way, and for guiding the load bearing part, a lead screw in the guide rail, and a corresponding threaded part attached to the load bearing part for co-operation with the lead screw, and means for rotating the lead screw whereby the threaded part and thus the load bearing part can be transversed along the guide rail.

For use as a lift for disabled people, the stair lift is preferably provided with limit switches at each end of its travel, and safety switches associated with the lift carriage for stopping the lift if tipping or other orientation changed take place indicating failure on the lift, or possible collapse etc. of the passenger.

A preferred embodiment of the invention will now be described by way of example, with reference to the accompanying drawings wherein.

Figure 1:
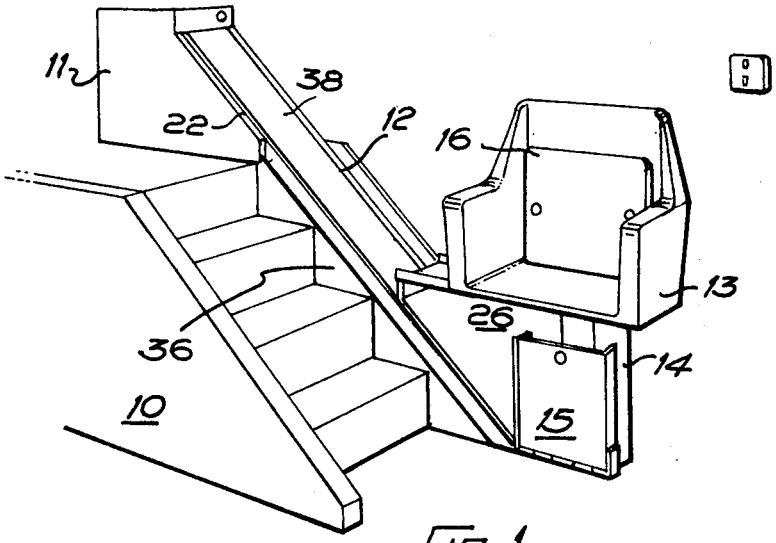
FIG. 1 is a perspective view of a stair lift according to the invention.
Figure 2:
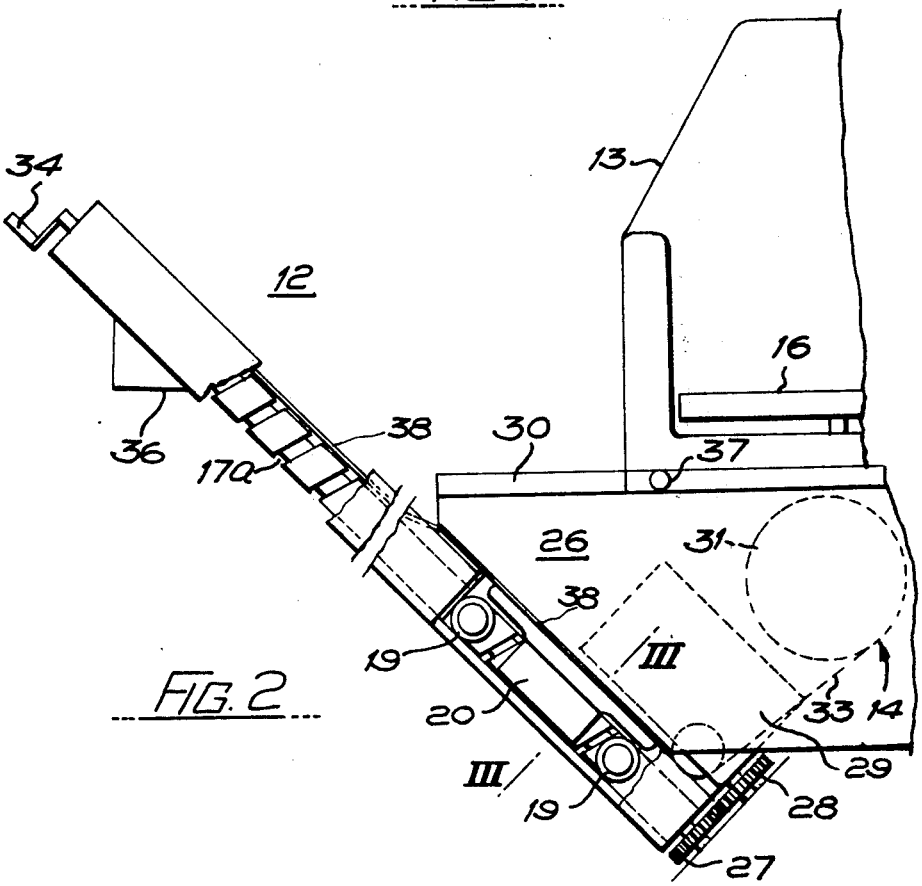
FIG. 2 is a diagrammatic view of part of the lift of FIG. 1.

As shown in FIG. 1 the stair lift according to the invention is mounted on one side of a staircase 10. A motor guard housing 11 is provided at the top of the stairway. A chair 13 is mounted so as to be guided in the rail 12 and has a foldable foot plate 15 and a foldable seat 16 which can be either extended horizontally for use, or folded back vertically as shown to reduce space requirements and enable ordinary use to be made of the stairway. The chair includes a casing 14 included in its plinth.

A lead screw 17 having a helical thread **17*a* extends the length of and within the rail 12. The screw 17 is supported for rotation within the rail 12 by a nylon bearing strip 18** with a semi-circular cross-sectioned channel therealong corresponding in radius to the outer dimensions of the lead screw.

The chair 13 runs on the rail 12 by means of two pairs of trunnions 19 which each runs between a flange 23 of the rail 12 and a raised part of its base 24. The trunnions 19 are carried on stub axles mounted on a stirrup.

The block 21 has a semi-circular cross-sectioned recess formed with a thread corresponding to that on the lead screw 17 and co-operates therewith so that when the lead screw is rotated, the block 21 will move longitudinally of the screw 17.

The rail 12 is formed as an extruded aluminium strip of complex cross section and has upper flanges 22 on each side for guiding a leg 26 the seat 13 carried on the stirrup 20, and round a guard 38 of plastics sheet material for the lead screw, and also dove tailed section longitudinally extending grooves 25 at each side for use in fitting the rail 12.

The lower end of the lead screw 17 carries a sprocket 27, which is driven by a meshing drive sprocket 28 which is powered by an electric motor and reduction gear assembly 29 all contained in a neat housing at the base of the lift. Alternatively or additionally e.g. beneath the stairs an electric motor is coupled in driving engagement perpendicular to the lead screw out of the path of the chair leg. The reduction gear assembly 29 is in the full view of FIG. 1, provided in the stair top housing 11.

A rewind reel 31 is provided inside the chair plinth housing 14, and this is used in manual rewinding of the chair to the top or bottom in the event of breakage. The reel takes up a cord 33 reeved on a pulley 32 and guided alongside the rail 12 in a channel 35 defined by an L-shape web which is entegral with the rail 12.

In addition a detachable handle 34 is provided which can be used to turn the lead screw to move the chair 13 in the event of a power failure leading to standing of the lift or rendering it inoperative.

The described and illustrated embodiment can be installed on house stairways, and removed, without structural alteration to the house. It can be adapted to any length of stairway, and to spiral or dog-legged stairways by providing curved section of guide rail 12 and making the lead screw flexible e.g. a spring 17' the coils of which are continuous with the screw thread.

For a chair-lift for use by a seated person, as described, a single rail 12 on one side of the stairway is sufficient. However for use in carrying wheel chairs, the lift may be modified by providing a rail 12 one or both of which contains a lead screw, on each side of the stairway, and a platform for carrying a wheel chair supported horizontally between them, on carriages.

The seat 13 can be horizontally moved on the housing 14 by a slideway 30 in which nylon bushes 31 on the seat run. The rail 12 may be secured on the stairs by triangular brackets 36 which rest in a step recess.

Figure 4:
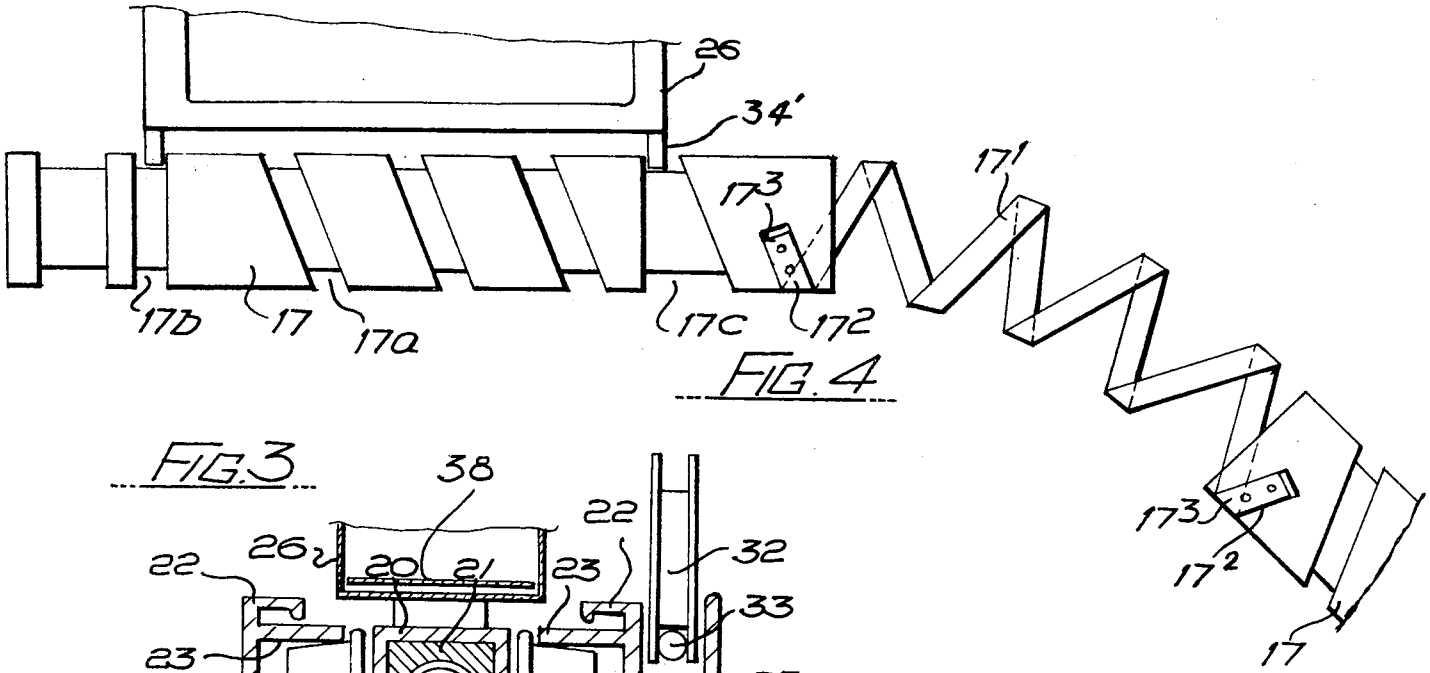
FIG. 4 is a diagram of the lead screw showing how it can be used to traverse corners.
Figure 3:
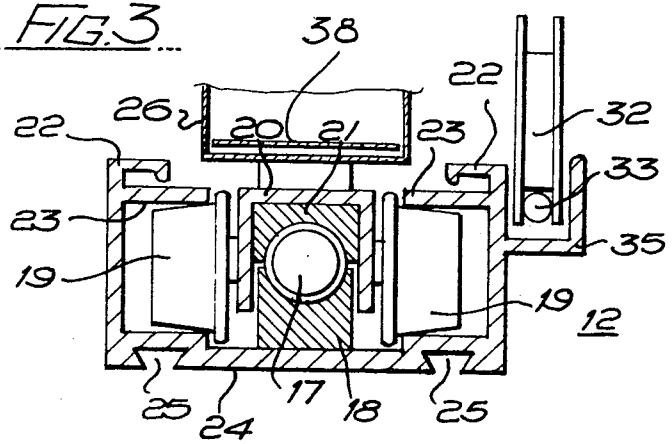
FIG. 3 is a sectional view on line III—III of FIG. 2.

Referring now to FIG. 4, the flats **17*b*, 17*c*, being lands extended from the thread 17*a* peripherally of the lead screw 17 in two planes normal to its longitudinal axis, prevent over running of the nuts. The planes are spaced apart corresponding to the spacing of the nut runners 34' on the leg 26 for seat 16 of chair 13, whereby both simultaneously cease to be axially urged upon reaching an end of the stairs whether or not the lead screw 17 keeps turning. Spring 17[1] connects adjacent inclined parts of lead screw 17 maintaining the pitch of thread 17***a* in the path of the projecting nut runners 34'. End portions 17[2] of spring 17[1] are apertured. Recesses 17[3], inclined relative to the axis in correspondence to the pitch of the thread at adjacent ends of the lead screw parts, receive the apertured end portions 17[2], of the spring for secural by screws or rivets.

The lift also has the following safety features.

1. A pressure switch on a retainer tube for holding a disabled person on the lift seat.

2. An alarm bell within reach of the passenger.

3. A safety tube along the front (upstairs) edge of the platform, which when compressed operates a pressure switch which cuts off the motor circuit until the switch is re-set. This tube would be of rubber of flexible plastics.

4. A cut-off limit switch at each end of the guide rails.

5. The lead screw has an unthreaded peripheral flat 17*b* and 17*c* at each end so that if the limit switches fail, the nut runs off the screw and ceases to travel. When the load is lifted off the chair a spring or buffer will re-engage the lead screw nut on the thread.

6. A stair lift wherein an auxiliary means for rotating the lead screw is provided in the form of a detachable handle engageable with either or both ends of the lead screw for manually rotating the lead screw.

7. A stair lift wherein the lead screw has flexible portions for negotiation of corners, comprising a helical spring of pitch equivalent and continuous with the thread of the screw.

What I claim is:

1. A stair lift comprising a load bearing part, a guide rail for extending up one side of a stair way and, for guiding the load bearing part, a lead screw in the guide rail having a plurality of differently inclined sections, at least one spring for connecting adjacent screw sections, the coils of the spring being continuous with the screw thread for maintaining the pitch of the thread, and a corresponding threaded part attached to the load bearing part for co-operation with the lead screw, and means for rotating the lead screw whereby the threaded part and thus the load bearing part can be traversed along the guide rail, and wherein the lead screw is seated on a strip extending longitudinally of the guide rail having a semicircular cross-sectioned recess for the lead screw.

2. A stair lift according to claim 1 wherein the guide rail is an extruded aluminium strip partially enclosing a channel in which the lead screw is accommodated.

3. A stair lift according to claim 1, wherein the means for rotating the lead screw comprises an electric motor and further comprising a motor guard/housing intended for mounting at the top of the stairway.

4. A stair lift according to claim 1, wherein the corresponding threaded part is secured to a stirrup, which carries two pairs of trunnions, which run between upper and lower flanges of the guide rail.

5. A stair lift according to claim 1, wherein the means for rotating the lead screw comprises an electric motor coupled to the screw by a meshing sprocket transmission.

6. A stair lift according to claim 1, wherein the load bearing part comprises a chair, mounted on a base so as to be slidable thereon, and having a foldable seat and foot rest.

* * * * *